US006183597B1

(12) United States Patent
Siegle

(10) Patent No.: US 6,183,597 B1
(45) Date of Patent: Feb. 6, 2001

(54) METHOD OF PRODUCING A PULP FROM CELLULOSIC MATERIAL USING FORMIC ACID AND HYDROGEN PEROXIDE

(75) Inventor: Sven Siegle, Winnenden (DE)

(73) Assignee: Natural Pulping AG, Winnenden (DE)

( * ) Notice: Under 35 U.S.C. 154(b), the term of this patent shall be extended for 0 days.

(21) Appl. No.: 08/945,345

(22) PCT Filed: May 2, 1996

(86) PCT No.: PCT/EP96/01823

§ 371 Date: Dec. 3, 1998

§ 102(e) Date: Dec. 3, 1998

(87) PCT Pub. No.: WO96/35013

PCT Pub. Date: Nov. 7, 1996

(30) Foreign Application Priority Data

May 3, 1995 (DE) ..... 195 16 151

(51) Int. Cl.[7] ..... D21C 3/20

(52) U.S. Cl. ..... 162/16; 162/37; 162/65; 162/76; 162/78

(58) Field of Search ..... 162/65, 76, 78, 162/96, 47, 97, 249, 16, 250, 30.1, 30.11, 29, 37, 40

(56) References Cited

U.S. PATENT DOCUMENTS

| | | | | |
|---|---|---|---|---|
| 3,553,076 | * | 1/1971 | Haas et al. | 162/76 |
| 3,654,070 | * | 4/1972 | Pradt et al. | 162/65 |
| 4,451,567 | | 5/1984 | Ishibashi et al. . | |
| 4,793,898 | | 12/1988 | Laamanen et al. . | |

FOREIGN PATENT DOCUMENTS

| | | |
|---|---|---|
| 25 06 919 B2 | 2/1978 | (DE) . |
| 30 05 947 B1 | 1/1981 | (DE) . |
| 38 30 993 A1 | 4/1989 | (DE) . |
| 0 250 422 B1 | 3/1986 | (EP) . |
| 0 325 891 A1 | 8/1989 | (EP) . |
| 0 335 242 A2 | 10/1989 | (EP) . |
| 0 508064 A1 | 10/1992 | (EP) . |
| 0 511 695 A1 | 11/1992 | (EP) . |
| 0 535 741 A1 | 4/1993 | (EP) . |
| 0 578 305 A1 | 1/1994 | (EP) . |
| 0 584 675 A1 | 3/1994 | (EP) . |
| 1014536 | 8/1952 | (FR) . |
| 2 593 527 A1 | 7/1987 | (FR) . |
| 2 665 193 | 1/1992 | (FR) . |
| 2 672 065 | 7/1992 | (FR) . |
| 555985 | 9/1943 | (GB) . |
| 850367 | 10/1960 | (GB) . |
| 761647 | 9/1980 | (RU) . |
| 821614 | 4/1981 | (RU) . |
| WO 88/06202 | 8/1988 | (SE) . |
| WO 82/01902 | 6/1982 | (WO) . |
| WO 86/05529 | 9/1986 | (WO) . |

OTHER PUBLICATIONS

International Search Report PCT/EP96/01823.
International Search Report 195 16 151.3 (German).

* cited by examiner

*Primary Examiner*—Steve Alvo
(74) *Attorney, Agent, or Firm*—Blank Rome Comisky & McCauley LLP

(57) ABSTRACT

A process for producing a pulp from cellulose-containing material, wherein the material is reacted with formic acid as the solvent, and cooked at approximately the boiling temperature of the solvent, whereby return condensation is used. Annual plants, deciduous or coniferous wood can be used as the cellulose-containing material. In one variant of the process, the cellulose-containing material is only slightly warmed, whereby backflow cooling is used, and then a precisely predetermined quantity of hydrogen peroxide is slowly added to the liquid at a constant rate. This process variant can be repeated at a lower cooking temperature. The pulp thus obtained is preferably utilized in the production of cellulose, and in particular in the production of paper or cardboard. It is proposed that the lignin, which is isolated from the cellulose-containing material, have further applications, whereby such lignin is, after the pulp has been separated from the solvent, itself precipitated out in water. The lignin thus obtained can be used as a new building material, as a filler material or as an output substance to be used in the manufacture of aromatic products.

18 Claims, No Drawings

METHOD OF PRODUCING A PULP FROM CELLULOSIC MATERIAL USING FORMIC ACID AND HYDROGEN PEROXIDE

BACKGROUND OF THE INVENTION

The invention relates to a process for producing a pulp from cellulose-containing material, the pulp itself and its application.

By pulp is meant a cellulose mash that is used in the production of chemical pulp, which, in turn, is used to make paper or cardboard. The cellulose-producing industry today is finding it increasingly difficult to meet the environmental standards and requirements imposed on it. In addition, it is no longer permitted in Germany, by virtue of the environmental regulations of 1990, to use conventional processes for recovering cellulose, such as the sulphite process. In Germany today the sulphite process is the only process wherein sulphur-containing digestion agents are used to dissolve the lignin, which serves as a binder, out of the cellulose-containing material.

One result of efforts to develop more environmentally-friendly processes for recovering cellulose is the so-called Acetosolv process, in which the digestion liquid contains at least 50 percent by weight of acetic acid, to which is added a very small quantity of hydrochloric acid. Following digestion, the recovered pulp is washed with caustic soda and, if required, with organic solvents, in order to more or less completely remove the lignin.

The disadvantages of this process are the relatively high consumption of acetic acid, the use of caustic soda, and the organic solvents that may be needed to wash the pulp.

In accordance with the stringent requirements of the paper industry, the extracted pulp is regularly bleached in a subsequent step, in order to keep the Kappa number at the most below 25. Even the Acetosolv process includes downstream bleaching with peroxide, with respect to which it should be pointed out that high use is not advantageous.

EP 0 325 891 A1 discloses an improvement to this Acetosolv process. The improvement comprises in essence that the pulp be washed following the digestion step, not with caustic soda, but with a $C_{1-3}$-carboxylic acid, or with a mixture of such acids, whereupon the subsequent bleaching step is carried out in the existing acid medium, to which hydrogen peroxide or ozone is added. A carboxylic acid such as, for example, butyl acetate, can be used as the solvent. This patent also discloses that the $C_{1-3}$-carboxylic acid can later be re-used as a digestion liquid.

Disclosed in EP 0 250 422 B1 is a process commonly known as the Milox process, in which bleached pulp is produced from cellulose-containing material. In this process, digestion is accomplished in a peroxyformyl, peroxyaceto, peroxypropional or peroxybutyric acid medium, wherein recovery of peroxic acid is effected in that the acid used is mixed with a relatively large quantity of hydrogen peroxide, whereupon the digestion process continues. Following digestion, the pulp is bleached in an alkali solution to which hydrogen peroxide has been added. The disadvantage of this process, however, is the use of an alkali solution such as caustic soda, as well as the high proportion of hydrogen peroxide required.

Using this prior art as the basis, the present invention aims to develop a process for producing a pulp from cellulose-containing material that is environmentally-friendly, highly economical and efficient.

OBJECT AND SUMMARY OF THE INVENTION

This object is addressed in the process in accordance with Claim 1. Accordingly, we are surprised to discover that, depending on the type of cellulose-containing material employed, it is necessary only to dissolve the material by using formic acid as the solvent and to cook the liquid at approximately boiling point while employing backflow cooling. Use of suitable cellulose-containing material yields pulp so surprisingly white that subsequent bleaching is unnecessary.

If the cellulose-containing material used is difficult to digest, a preferred embodiment of the proposed process can be employed. This is the case, for example, with deciduous or coniferous wood and also with straw, depending on the use to which the recovered pulp will be put. In this preferred embodiment, the cellulose-containing material is reacted with formic acid and water and then slightly heated by means of an external energy source, whereby backflow cooling is used. Next, a precisely predetermined quantity of hydrogen peroxide is slowly added at a constant rate. This process method, which has never before been disclosed in the prior art, provides for a very economical process, since the exothermic reaction itself supplies the heat required for digestion; i.e. except for start-up activation, no further energy is required. At the same time, control of the reaction is considerably simplified, since only a small, predetermined amount of hydrogen peroxide is added to the digestion solution. By digestion solution in the present invention is meant the totality of solvent, cellulose-containing material and the components thereof that may be dissolved therefrom, such as lignin and sugar. Furthermore, it is advantageous for the execution of the reaction in accordance with the preferred embodiment, that the balance in the reaction of the formation of per acid from formic acid and hydrogen peroxide through the continuous addition of hydrogen peroxide, be constantly shifted toward per acid.

The proposed process comprises that hydrous formic acid be employed in a concentration between approximately 60 and 99 percent by weight. The use of 100% formic acid is not advantageous, since at least a certain percentage of water should be present during pulp production, i.e. during the digestion step. Digestion time should run approximately 30 to 120 minutes, depending on the cellulose-containing material employed.

The predetermined quantity of hydrogen peroxide can be between approximately 1 to 3 percent by weight, preferably from 1 to 2 percent by weight, whereby 1 percent by weight is particularly preferred, relative to the total weight of cellulose-containing material and solvent. It is particularly advantageous in this case that only a very small amount of hydrogen peroxide need be added, which is sufficient on the one hand to ensure that the pulp thus produced meets the brightness requirements of the paper to be manufactured, and on the other hand, that the temperature of the digestion solution be kept in the vicinity of the boiling point of the solvent without further external energy in the form of heat being required. Thus, the characteristics required of the proposed pulp for producing paper can be obtained with a minimal expenditure of energy.

It has proven advantageous if the ratio of liquid to material is in the range of 20:1 to 25:1.

The proposed process can, furthermore, be modified in that, additionally, a gas such as air, oxygen, ozone or a comparable gas or a mixture of two or more of these gases is introduced into the solvent. In this case, the oxidizing power of these gases is utilised in order to facilitate lignin breakdown, which increases brightness and lowers the Kappa number. In addition, the time required for digestion is reduced.

It is proposed that the pulp, following termination of the digestion step, be separated from the solvent, simply by means of screening. In this case, screening is understood in its most general sense, that is, separation by means of a suitable membrane, a filter or a frit, in order to permit the separation procedure to be accomplished in a continuous manner. The pulp, now separated by means of the screening procedure, can be washed with water and/or formic acid. In particular, if the pulp is washed with formic acid, the remaining lignin, which has already been dissolved out of the cellulose-containing material, is floated off. This floating action can be facilitated if the pulp is agitated by means of a stirrer.

If formic acid is used to wash the pulp, such formic acid, together with the solvent from the digestion process, can be recovered by means of simple distillation. The proportion of recovered formic acid is, as a rule, over 95 percent by weight. The remaining formic acid stays in the lignin as a residue.

The pulp, after being washed with formic acid, is neutralised by washing with water; if desired, the wash water can also undergo the aforementioned distillation process, so that whatever formic acid remains in the pulp can be recovered.

The aforementioned proposed process or its preferred embodiment suggests a single-step process to produce a pulp from cellulose-containing material, that is suited, for example, to the production of paper of adequate brightness (e.g. Kappa number <10) entailing a minimal use of energy.

Depending on the type of cellulose-containing material used, or depending on the particular characteristics of the paper that is to be produced from the pulp, it may be necessary to further increase pulp brightness. This is also enabled by a particularly preferred embodiment of the proposed process that entails both a minimal energy expenditure, and a minimal equipment requirement, since it is expected that the proposed process will be repeated. In this case, the digestion temperature is reduced. Employed as a solvent can be hydrous formic acid, to which hydrogen peroxide is added, as described above. The lowered digestion temperature can be in the range of approximately 70 to 80° C. It is preferred that the digestion temperature be 70° C. since this temperature is optimal for the presence of performic acid. At the same time, in the interest of increasing brightness, digestion time can be extended by up to 5 hours. Preferably, however, digestion time should be approximately 3 hours, since it has been determined that, after this length of time, no noticeable brightening of the pulp occurs. It has also proven advantageous to raise the ratio of liquid to material to over 25:1.

Elephant grass (Miscanthus) and/or corn ears or stalks can be used as the cellulose-containing material. Both materials, elephant grass in particular, are readily digestible. In this case, even the addition of hydrogen peroxide to the solvent can be omitted. Thus, for example, use of 99% formic acid combined with a cooking time of one hour, enabled a Kappa number of 4.7 to be obtained.

A particular advantage of the proposed process is, however, that annual plants, in particular grain straw, can be used as cellulose-containing material. This is particularly important for the manufacture of paper, because, up until this time, wood was practically the only cellulose-containing material used in this process. World-wide on an annual basis, over 200 million tonnes of paper are consumed, and the requirement is growing. The stripping of great tracts of forest in order to cover the cellulose-containing material needs causes considerable environmental problems, such as climate change and the destruction of plant and animal environments. Whenever reforestation is carried out, if at all, mostly only fast-growing monocultures are planted, which, being themselves highly susceptible to disease, have no ecological value. Moreover, even developing nations, or nations of the so-called "Third World", are experiencing a growing need for paper in a variety of sectors. In most cases, wood is not available for use as the cellulose-containing material in the prior art production processes. In this case, straw, particularly with respect to costs and ecological concerns, is an eminently sensible substitute. Often, straw is even seen as so much unwanted garbage, and is burnt in the fields in an environmentally-unfriendly manner. Since in Germany alone some 50 million tonnes of straw remain after each harvest, an enormous amount of cellulose-containing material is available. This applies more so to countries such as the USA or Canada, that are known to have enormous grain fields. In developing countries, or so-called Third World countries, the planting of simple annual plants can be one way of utilising difficult soils under adverse climatic conditions. In this case, it is possible, wherever the planting of more sensitive crops is no longer feasible due to weather or soil conditions, to switch to the growing of the simpler annual plants, in order to provide cellulose-containing material for the manufacture of pulp for the paper industry.

If grain straw is employed, it has proven practical if the preferred embodiment of the proposed process be used, and that a precisely predetermined amount of hydrogen peroxide be continuously added at a constant rate to the digestion solution. This process allows paper of adequate brightness to be produced from the pulp. The repetition of the process in accordance with the particularly preferred embodiment involving lowering the cooking temperature and increasing the cooking time if necessary, is of course, one option that can be selected.

The proposed process can also be utilised in the case of the usual cellulose-containing materials, such as deciduous or coniferous wood. Since it is known that it is more difficult as a rule when using such materials to obtain from the pulp a paper of sufficient brightness, it is suggested that the especially preferred embodiment of the process be used, and the process as proposed, which involves reducing the digestion temperature and optionally extending the digestion time, be repeated.

A further aspect of the present invention relates to the lignin that is dissolved out of the pulp during the proposed process. After the formic acid, which is employed as a solvent, has been recycled by means of simple distillation, the lignin is recovered from the distillation residue by precipitation in water. Through the precipitating out of the water-insoluble lignin, the latter is simultaneously separated from the water-soluble sugars that are present in the residue.

The invention also relates to a pulp of cellulose-containing material that can be obtained in accordance with the proposed process, and optionally in accordance with its preferred or its especially preferred embodiment.

The invention also relates to the use of the pulp thus obtained in the production of cellulose, for example, in the paper industry, or for the production of cardboard. It will, of course, be appreciated that the pulp, which has been produced in accordance with the proposed process, can be employed wherever cellulose is required as the output material for a product. Thus, for example, a chemical cellulose or another product made from regenerated or chemically modified cellulose, can be produced from the proposed pulp.

The invention also relates to lignin that can be obtained in accordance with the proposed process. This lignin can, of course, be further processed, since it contains no sulphur or chlorine components, such as has usually been the case with pulp that has been produced by prior art processes. The lignin thus isolated may, for example, be used as a building material and in particular as output material for pressed chipboard, fibreboard of medium density, or as filler material, if further reacted with oxalic acid and either melted or cooked in a saturated formic acid solution and then concentrated or evaporated with cellulose fibres. The result is a waterproof black-brown mass.

The range of applications for lignin, however, is far wider. For instance, lignin can be used as an output material in the production of aromatic substances such as vanilla or mulled wine essence.

DESCRIPTION OF THE PREFERRED EMBODIMENTS (BEST MODE)

The invention will next be described in greater detail with the aid of embodiment examples.

1. Production of Pulp from Elephant Grass

Elephant grass was mixed with a 90% solution of formic acid in a liquid-to-material ratio of 25:1 and heated up to the boiling point of the solution, with backflow condensation being employed. In a laboratory experiment, a round-bottom flask was used as the reaction vessel, together with a ground glass stopper thermometer and a Dimroth backflow condenser. A heating pad or heating plate supplied heat. After 90 minutes cooking time, the digestion vessel was allowed to cool down, the pulp separated from the digestion solution by means of simple screening and then washed with water. The pulp yielded can be further processed into paper.

In one variant of this process, the pulp obtained after screening was washed with hydrous formic acid as follows: additional formic acid, in a concentration from 60 to 80 percent by weight, was added in order to float off the remaining lignin. A blade stirrer was then placed in the reaction vessel and the solution stirred for approximately one minute. Agitation by means of stirring causes the cellulose fibres to split, which facilitates lignin flotation. The formic acid, after being separated out, was distilled off, together with the formic acid of the above-described digestion reaction, by means of simple distillation. In the laboratory procedure, the Liebig distillation apparatus with a 300 mm column was employed. By this means, the formic acid used is largely recovered. The lignin dissolved out of the residue can be readily precipitated out in water and further processed. Dissolved hydrocarbons can be recovered by means of evaporation. The pulp was washed with water, neutralised, and then air-dried. A Kappa number of 15 and a yield of 45% were achieved.

2. Production of Pulp from Corn Ears

In a process as described in 1., a 99% solution of formic acid was cooked for 60 minutes. An analysis of the pulp obtained gave a Kappa number of 4.7 with a yield of 28%.

3. Production of Pulp from Straw

Cereal straw, formic acid and water were placed in the reaction vessel in the percent-by-weight proportions and in the liquid-to-straw ratio given below. In a laboratory procedure, a round-bottom flask was employed together with a ground stopper thermometer and a Dimroth backflow condenser. Next, the reaction mixture was slightly warmed, with backflow condensation being employed. Hydrogen peroxide in the concentration given below was then added continuously. The reaction, being exothermic, permitted the external energy supply, provided by means of a heating pad or heating plate, to at first at least be reduced, and then entirely omitted. The digestion time is also given below. After the cooking time had ended and the reaction vessel cooled down, the pulp was separated from the digestion solution by means of simple screening and mixed together with additional fresh formic acid in a concentration from 60 to 80 percent by weight, in order to float off the remaining lignin. A blade stirrer was next placed inside the reaction vessel and run for about one minute, the result being a splitting up of the cellulose fibres, thus facilitating lignin flotation. The formic acid, after being separated out, was recovered together with the formic acid of the digestion solution by means of simple distillation. For this purpose, a Liebig distillation apparatus with a 300 mm column was used. By such a method, the formic acid employed can be largely recovered. As a rule, the amount recovered is over 95%. Remaining was a residue that comprised lignin and sugars or rather, superfluous carbohydrates, and the unrecovered solvent that remained as residual moisture. The insoluble lignin was then separated from the soluble sugars by means of precipitation in water, whereupon it could be further processed. The pulp was neutralised by washing with water, and then air-dried.

In the experiments given, digestion times of 30, 45, 60, 90 and 120 minutes were selected. These were combined with formic acid concentrations of 50, 60, 75, 80, 85, 90, 95 and 100%. The quantity of added hydrogen peroxide was varied between 1% and 2%. It was discovered by this means that the addition of more than 1% of hydrogen peroxide confers no additional advantage, but rather, due to the more powerful exothermic reaction, control of the digestion process is rendered more difficult. Digestion temperature in these experiments was always kept at the boiling point of the solvent.

Two experiments are next described by way of example. In these experiments, the liquid-to-straw ratio is described as the floating ratio. The experiment parameters given provide for optimised production conditions, whereby the purpose of optimisation in experiment 3.a) was not only maximum lignin removal, but also recovery of as great a quantity of lignin as possible. It has been demonstrated that optimal lignin removal is related to the degradation of lignin up to water solubility. Optimisation was also carried out in order that non-degraded or non-modified lignin be recovered in addition to as much lignin-free pulp as possible.

| Experimental Parameters 3.a) | |
|---|---|
| Floating ratio | 25:1 |
| Formic acid concentration | 80% |
| Water concentration | 20% |
| Digestion time | 2 hours |
| Pulp yielded | 56% |
| Lignin yielded | 21% |

The above and all further numerical data are expressed in percent by weight unless otherwise indicated. The percentage data with respect to the lignin yield are with respect to the total mass of water-insoluble residues.

| Experimental Parameters 3.b) | |
|---|---|
| Floating ratio | 25:1 |
| Formic acid concentration | 75% |

-continued

| | |
|---|---|
| Hydrogen peroxide concentration | 1% |
| Water concentration | 24% |
| Digestion time | 30 minutes |
| Pulp yielded | 56% |
| Lignin yielded | 38% |

It should be noted that, if the purpose of the process is to recover as much non-degraded lignin as possible, hydrogen peroxide should not be used at all in the digestion process.

4. Modifying the Production of a Pulp from Straw

Special requirements regarding the quality of the pulp produced, or rather the paper that is produced therefrom, can require that brightness be increased. In such a case, the digestion process described in 3. can be repeated, whereby it is most advantageous to select concentrations that are essentially the equivalent of the concentrations set out in 3.

First, the straw is processed as described in 3. After the cooking time has elapsed, a stirrer is inserted and the pulp agitated for approximately one minute. Subsequently, the digestion solution is separated from the pulp and further processed without being dried. Following are the parameters of an experiment on the production of a pulp involving a repeated step. The repeated step is indicated with the number 4.b.

| Experimental Parameters: Digestion Reaction | 4.a) | Repetition 4.b) |
|---|---|---|
| Float ratio | 1:25 | >1:25 |
| Formic acid concentration | 60% | 60% |
| Water concentration | 39% | 39% |
| Hydrogen peroxide concentration | 1% | 1% |
| Cooking temperature | 106° C. approx. | 70–80° C. |
| Cooking time | 30 mins. | 3 hrs. |

At the end of both steps the yields were:

Pulp: 25%

Lignin: 20.2%

5. Production of a Pulp from Coniferous Wood

It is known that paper that has been produced from the pulp of coniferous wood often does not meet the brightness requirements of the paper industry. By means of the process shown in 4., especially when the digestion process as shown under 4.b. is repeated, it was possible to produce a pulp exhibiting an adequate level of brightness. The experimental parameters are given below.

| | 5.a.) | 5.b.) |
|---|---|---|
| Float ratio | 1:25 | >1:25 |
| Formic acid concentration | 85% | 85% |
| Water concentration | 13% | 13% |
| Cooking temperature | 106° C. approx. | 70–80° C. |
| Cooking time | 4 hrs. | 4 hrs. |

6. Modification of the Production of a Pulp in Accordance with 1., 3. or 4.

The different options for producing a pulp as described can be further improved by the addition to the digestion process of a gas such as air, oxygen, ozone or a similar gas, in order to utilise the oxidising power of such gas to facilitate digestion. A mixture of two or more of the said gases can also be used.

The digestion process described above, or one of its variants, comprises that the type of gas selected or a gas mixture, be introduced from below via a wide nozzle into the reaction vessel. This procedure can be carried out continuously or discontinuously. Next, the escaping gas can be used again or removed in an environmentally-friendly manner, with the aid of known suitable methods.

7. Further Utilisation of Lignin

Following recovery of the formic acid from the digestion solution by means of simple distillation, a residue comprising lignin and sugars, or rather the residual carbohydrates, remains. The undissolved lignin is separated from the soluble sugars by precipitation in water. Since the lignin in the proposed process is advantageously not contaminated by either sulphur or chloride components, it can be further processed as a matter of course. The further processing options are extraordinarily varied.

7.a. Modification of the Lignin Recovery Process

Instead of the process procedure described above, wherein the lignin is recovered by being precipitated out in water, the lignin, which, during the digestion process, is found dissolved in the solvent, can be removed by means of a continuous process. To this end, arranged on the reaction vessel is a suction apparatus that continuously pumps off the digestion solution, which flows through a membrane filter, frit or a similar separation device, by which means the lignin is then separated from the digestion solution and drawn off. The remaining digestion solution is then pumped back into the reaction vessel that served in the digestion process. By this means, lignin condensation, which acts as a reaction that competes against the lignin splitting, is suppressed. In addition, the boiling point of the digestion solution is lowered, since the proportion of dissolved material is reduced. A further advantage is obtained due to the greater ease of recovering the digestion solution, and in the savings in the chemicals required, since, in accordance with this variation on the process, the already dissolved material need not be re-dissolved.

7.b. Further Processing into a Construction Material

For this purpose, lignin is reacted with an excess of oxalic acid and melted or, in accordance with another process variation, cooked in a saturated formic acid solution and then concentrated with cellulose fibres. The result is a waterproof black-brown mass that can be used as a filler material or in chipboard or fibreboard.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A process for recovering pulp from a cellulose-containing material, comprising the steps:

(a) admixing said cellulose-containing material with an aqueous solvent comprising formic acid;

(b) raising the temperature of said admixture to the approximate boiling point of said solvent;

(c) then slowly adding hydrogen peroxide to said heated admixture in an amount and at a rate such that the temperature of said admixture is maintained without an external source of heat; and then (d) recovering pulp from said admixture.

2. Process in accordance with claim 1, wherein said formic acid is hydrous and is employed at a concentration ranging between approximately 60 and 99 percent by weight.

3. Process in accordance with claim 2, whereby the predetermined amount of hydrogen peroxide is approximately 1–3 percent by weight, as related to the total weight of cellulose-containing material and solution.

4. Process in accordance with claim 1, wherein step (c) is carried out in approximately 30–120 minutes.

5. Process in accordance with claim 1, wherein the aqueous solvent is admixed with the cellulose-containing material to provide a liquid to material ratio of approximately 20:1 to 25:1.

6. Process in accordance with claim 1, further including the step of introducing into the solvent an oxygen-containing gas taken from group consisting essentially of air, oxygen, ozone, or mixtures.

7. Process in accordance with claim 1, wherein following the end of step (c), the pulp is separated from the solvent.

8. Process in accordance with claim 7, whereby the pulp is separated out by means of screening.

9. Process in accordance with claim 8, whereby the pulp obtained is washed with water and/or formic acid.

10. Process in accordance with claim 7, whereby over 95% of the formic acid is recovered by distillation.

11. Process in accordance with claim 10, wherein said distillation step yields a residue that contains lignin, said lignin being isolated by precipitation in water.

12. Process in accordance with claim 1, wherein the temperature of said heated admixture ranges from about 70° C. to 80° C.

13. Process in accordance with claim 12, wherein the time of step (c) is approximately 1–5 hours.

14. Process in accordance with claim 12, wherein the aqueous solvent is admixed with the cellulose-containing material to provide a liquid to material ratio of over 25:1.

15. Process in accordance with claim 1, wherein the temperature of said heated admixture is about 70° C.

16. Process in accordance with claim 1, whereby said cellulose-containing material comprises elephant grass and/or corn ears or stalks.

17. Process in accordance with claim 1, whereby said cellulose-containing material comprises annual plants, in particular, grain straw.

18. Process in accordance with claim 1, whereby said cellulose-containing material comprises deciduous or coniferous woods.

* * * * *